US006605248B2

(12) United States Patent
Rudisill et al.

(10) Patent No.: US 6,605,248 B2
(45) Date of Patent: Aug. 12, 2003

(54) PROCESS AND APPARATUS FOR MAKING MULTI-LAYERED, MULTI-COMPONENT FILAMENTS

(75) Inventors: Edgar N. Rudisill, Nashville, TN (US); Vishal Bansal, Midlothian, VA (US); Michael C. Davis, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/681,683

(22) Filed: May 21, 2001

(65) Prior Publication Data

US 2002/0056940 A1 May 16, 2002

(51) Int. Cl.[7] ..... D01D 5/32

(52) U.S. Cl. ..... 264/555; 264/172.14; 264/210.8; 264/211.14; 425/72.2; 425/131.5; 425/463; 425/66

(58) Field of Search ..... 156/167, 433; 264/169, 171.1, 555, 172.14, 210.8, 211.14; 425/131.5, 72.2, 463, 66

(56) References Cited

U.S. PATENT DOCUMENTS

| | | | | |
|---|---|---|---|---|
| 3,716,317 A | * | 2/1973 | Williams et al. | 264/172.14 |
| 3,841,953 A | | 10/1974 | Kohkamp et al. | |
| 3,860,383 A | | 1/1975 | Sirevicius | |
| 3,981,650 A | | 9/1976 | Page | |
| 4,043,739 A | | 8/1977 | Appel | |
| 4,285,655 A | | 8/1981 | Matsubara | |
| 4,547,420 A | | 10/1985 | Krueger et al. | |
| 4,889,476 A | * | 12/1989 | Buehning | 264/12 |
| 5,162,074 A | * | 11/1992 | Hills | 216/83 |
| 5,595,699 A | * | 1/1997 | Wright et al. | 264/169 |
| 5,620,644 A | * | 4/1997 | Hodan et al. | 264/169 |
| 5,728,407 A | | 3/1998 | Matsui | |
| 6,057,256 A | | 5/2000 | Krueger et al. | |
| 6,120,276 A | | 9/2000 | Balk | |

FOREIGN PATENT DOCUMENTS

| | | |
|---|---|---|
| GB | 2121423 A | 12/1983 |
| JP | 2289107 A | 11/1990 |

* cited by examiner

*Primary Examiner*—Michael W. Ball
*Assistant Examiner*—Barbara J Musser

(57) ABSTRACT

The present invention is directed to a process for forming a plurality of multi-layered filaments from multiple thermoplastic synthetic polymers and an apparatus containing a melt spinning beam which comprises multiple polymer inlet passages each communicating with separate multiple coat hanger distribution manifolds, separate filters connected downstream of each coat hanger distribution manifold, a combining manifold connected downstream of said filters and spinneret orifices connected downstream of said combining manifold for spinning of said multi-layered filaments.

7 Claims, 1 Drawing Sheet

PROCESS AND APPARATUS FOR MAKING MULTI-LAYERED, MULTI-COMPONENT FILAMENTS

BACKGROUND OF INVENTION

This invention relates to a process and an apparatus for producing melt spun multi-layered cross section multi-component filaments. These filaments can be collected and processed into nonwoven webs for use in filters, apparel, wipes, and hygiene products.

In a melt spinning process, thermoplastic synthetic polymers are melted and forced through orifices of a spinneret to form filaments. These filaments can be drawn or attenuated via air jets or mechanical means and collected on a moving porous surface to produce a random laydown of filaments or nonwoven web. The web can be bonded together to maintain its integrity. Also, in a melt blowing process, air jets can be added at the end of the spinneret to provide a very rapid drawing process providing very small diameter filaments.

In order to produce uniform filaments from a row of spinneret orifices, the polymer of each filament should be subjected to as nearly as possible the same heat history and residence time in the spinning apparatus. This can be accomplished using a polymer distribution manifold, which makes molten polymer with a longer travel distance move more quickly than molten polymer with a shorter travel distance. An example of a distribution manifold is a coat hanger (indicative of the general shape of the manifold) which can be found in U.S. Pat. Nos. 3,860,383; 4,043,739; 4,285,655; 5,728,407; and 6,120,276.

Bicomponent filaments which are made from two different polymers can also be melt spun. The separate molten polymer flow streams can be combined into layered polymer flow streams to make filaments with side-by-side cross sections in which filament portions each have distinct polymer components that extend for a significant portion of the length of each filament. An example of this in a meltblown process is U.S. Pat. No. 6,057,256. It is known, when making side-by-side cross section filaments, to combine polymer flow streams prior to using a coat hanger. Unfortunately, this eliminates the capacity for downstream filtering as filtering of the bicomponent melt stream would cause mixing of the layered polymer streams. It is also known, to use a coat hanger for each polymer flow stream and then to feed the polymer flow streams to a split hole die before being combined. Unfortunately, this split hole die can produce non-uniform filaments.

In systems where the polymers are not filtered, there are a significant number of spinneret orifices that plug during the start-up of the die and during operation, as the orifices are not protected from particles that come through the melt system. Essentially all melt processes will form particles that are large enough to plug the spin orifice. The source of these particles can be degraded polymer, gels, agglomerates, contaminants, etc. For most processes the typical number of plugged holes will start at 10–15 percent and will continue to increase during the run.

There is a need for a melt spinning apparatus and process for making uniform multi-layered cross section filaments which allow for downstream filtering, creation of layered polymer flow streams, and extrusion of the layered polymer flow streams through common unitary dies.

SUMMARY OF INVENTION

In a first embodiment, the present invention is directed to a process for preparing a plurality of multi-layered filaments from multiple thermoplastic synthetic polymers comprising separately melting and extruding multiple thermoplastic synthetic polymers into separate molten polymer flow streams, distributing said separate molten polymer flow streams into separate planar molten polymer flow streams, then filtering said separate planar molten polymer flow streams, combining said filtered separate planar molten polymer flow streams into a multi-layered molten polymer flow stream, and feeding said multi-layered molten polymer flow stream into a plurality of spinneret orifices to form multi-layered filaments.

Another embodiment of the present invention is an apparatus for carrying out the process described above, comprising multiple extruders for separately melting and extruding multiple thermoplastic synthetic polymers into molten polymer flow streams, separate distribution manifolds downstream of and communicating with said extruders for distributing said separate molten polymer flow streams into separate planar molten polymer flow streams, separate filters downstream of and communicating with said distribution manifolds for filtering said separate planar molten polymer flow streams, a combining manifold downstream of and communicating with said filters for combining said separate filtered planar molten polymer flow streams into a multi-layered molten polymer flow stream, and a spinneret downstream of and communicating with said combining manifold for transporting said multi-layered molten polymer flow stream through a plurality of spinneret exit orifices to form multi-layered filaments.

A further embodiment of the present invention is directed to a melt spinning beam for use in the process and apparatus described above which comprises multiple polymer inlet passages each communicating with separate multiple coat hanger distribution manifolds, separate filters downstream of and communicating with each coat hanger distribution manifold, a combining manifold downstream of and communicating with said filters and a spinneret having exit orifices downstream of and communicating with said combining manifold for spinning of said multi-layered filaments.

BRIEF DESCRIPTION OF DRAWINGS

The FIGURE is a schematic diagram of a transverse cross section of a melt spinning beam for producing side-by-side cross section bicomponent filaments according to the present invention.

DETAILED DESCRIPTION

Figure 1:
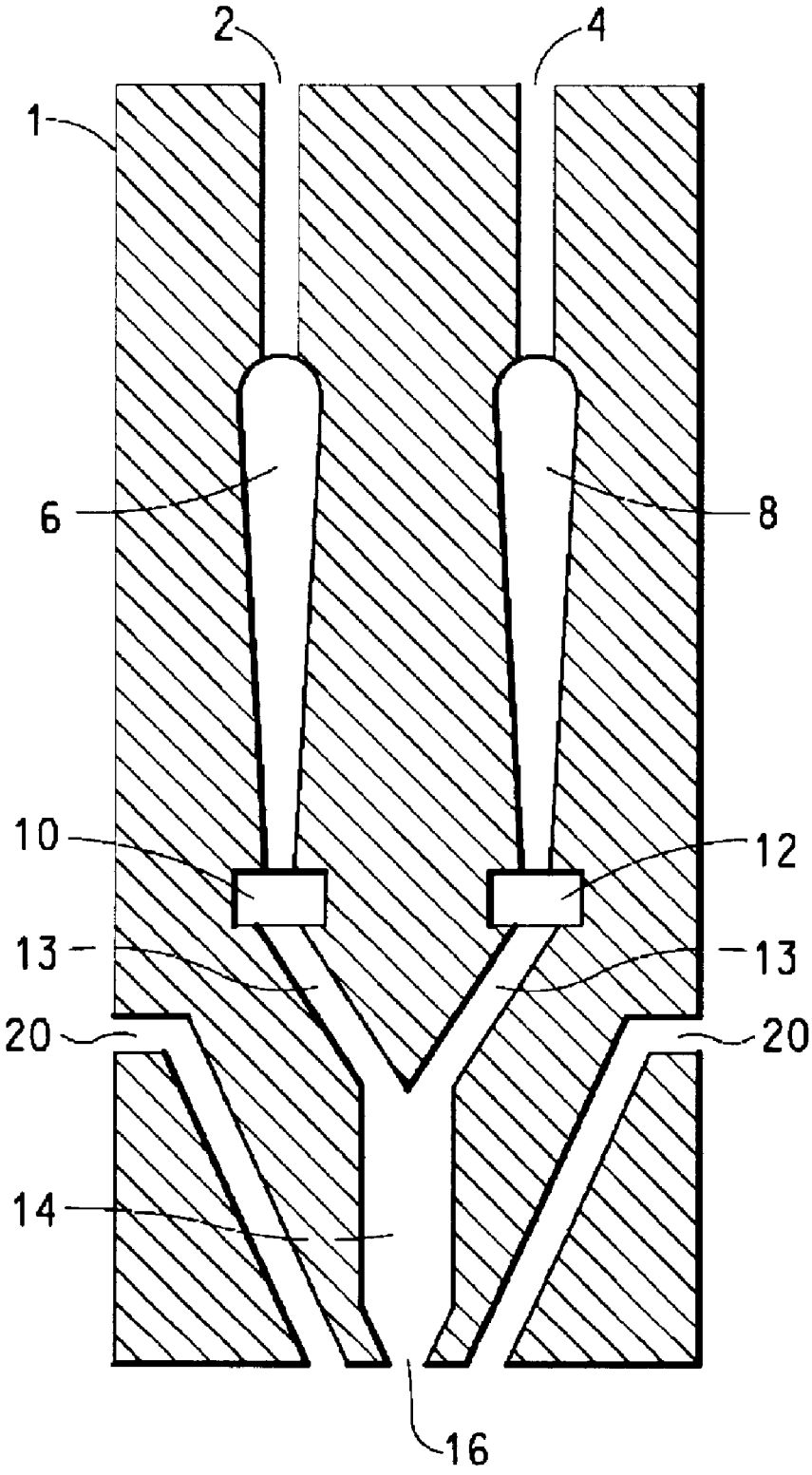

The term multi-layered filaments as used herein means filaments with a first polymer layer extending longitudinally along the fiber in contact with a second polymer layer extending longitudinally along the fiber with the second polymer optionally in contact with one or more other polymer layers.

The term multiple thermoplastic synthetic polymers as used herein means more than one distinct or dissimilar synthetically prepared heat processible polymer. This includes, but is not limited to, polyolefins, polyesters and polyamides. It also includes homopolymers, copolymers and blends of polymers.

The term molten polymer flow streams as used herein means a polymer heated above its melting point that can flow through a spinning apparatus.

The term planar molten polymer flow streams as used herein means a molten polymer flow stream that generally has a high width-to-height ratio cross section.

The term multi-layered molten polymer flow stream as used herein means a molten polymer flow stream made from two or more dissimilar planar molten flow streams wherein the planar molten flow streams are in contact along the width of the cross section.

The term distribution manifold as used herein means a device for spreading a polymer flow stream into a generally high width-to-height ratio cross section preferably with the polymer all along the flow stream cross section being subjected to nearly the same heat history.

The term combining manifold as used herein means a device for coupling two or more planar molten polymer flow streams into a multi-layered molten polymer flow stream.

The present invention is directed to melt spinning uniform multi-layered cross section multi-component filaments. These filaments can be collected on a forming screen and bonded together to produce a nonwoven web. This web can be used, for example, in filters, apparel, wipes, and hygiene products.

According to the invention, multiple thermoplastic synthetic polymers are separately melted into molten polymer flow streams, distributed into planar molten polymer flow streams, filtered, combined into a multi-layered molten polymer flow stream and fed to a plurality of spinneret exit orifices producing the multi-layered cross section filaments. Optionally, as the multi-layered molten polymer flow stream emerges from the spinneret exit orifice, the filament forming multi-layered molten polymer flow stream can be cooled and attenuated with high speed fluid, such as air from fluid jets to form very small diameter filaments as in melt blowing.

In multiple component filaments, the multiple thermoplastic synthetic polymers comprise at least two dissimilar polymers, which can be either chemically or physically dissimilar. The polymers can include polyolefins, polyesters and polyamides, and can be homopolymers, co-polymers or blends of polymers.

The polymers are melted into separate molten polymer flow streams using conventional means, such as extruders, and forced through separate distribution manifolds to produce separate planar molten polymer flow streams. The distribution manifolds arrange the molten polymer flow streams into long thin planes of molten polymer, wherein the polymer all along the plane has nearly the same heat history and residence time. It is optimal for the molten polymer stream to have as much as possible the same heat history and residence time in order to minimize degradation of the polymer contacting the manifold walls, which tends to form solidified particles which can plug the spinneret orifices downstream, and/or form less uniform spun filaments. A common distribution manifold is a coat hanger manifold, which is named as such due to its general resemblance (in longitudinal cross section) in form to a coat hanger. Due to the long, thin form of the coat hanger distribution manifold, heat from the walls of the melt spinning beam is transferred through the molten polymer almost instantaneously, thus minimizing heat gradients within the spin beam and reducing non-uniform heating of the polymer.

Likewise, due to the shape of the coat hanger distribution manifold, molten polymer which has a longer distance to travel within the manifold travels at a faster rate than that which has a shorter distance to travel. Accordingly, upon proper design of the coat hanger distribution manifold, all molten polymer within the manifold will have nearly identical residence time.

In spite of the use of coat hanger distribution manifolds, the molten polymer within the spinning beam is invariably somewhat degraded at the interface with the walls of the spinning beam, both within the coat hanger manifold and in the inlet passages to the spinning beam. Accordingly, in the present invention, the planar molten polymer flow streams are individually filtered prior to being combined, but downstream of the coat hanger distribution manifolds, greatly reducing or eliminating unwanted particulate passing into the spinneret which might plug the spinneret exit orifices. In this manner, each of the multiple molten polymer streams can be filtered, without causing upsets in flow after combination of the streams, which would adversely affect the layered natures of the streams and therefore the resulting filaments.

The filtered planar molten polymer flow streams are combined and spun through a common unitary die having spinneret exit orifices to produce multi-layered filaments. The layering of the polymers can be in any order and can be repeated as often as desired. Each layer contacts the surface of the filaments and extend for a significant portion of the length of the filaments.

In the simplest example, the filaments containing only two dissimilar polymers to prepare filaments of the invention are called bicomponent filaments. Also, in the instance of two layers, the filaments are called side-by-side cross section filaments. In another embodiment of the invention, the spinning beam may contain more than two flow pathways for more than two molten polymer streams. Thus, if three-component filaments are desired, the spinning beam would be configured to have three separate polymer inlet passages, three separate coat hanger distribution manifolds and three separate filters, which all feed into a single combination manifold, wherein the separate molten polymer streams are combined as a three-layered molten polymer stream, which feeds the spinneret exit orifices downstream to form three-component filaments as they exit the spinning beam. The skilled artisan will recognize that any number of separate flowpaths can be formed within the spinning beam, so as to form multiple-component filaments.

The invention can be described with reference to a specific example of preparing side-by-side cross section bicomponent filaments according to the spinning apparatus of FIG. 1.

FIG. 1 is a transverse cross sectional view of a two-component orthogonal spinning beam 1, which extends in the longitudinal direction, i.e. perpendicular to the plane of the page, for several meters. Two different thermoplastic synthetic polymers are separately melted in separate extruders (not shown) and fed into the spinning beam through inlet passages 2 and 4. The molten polymer is transported to two coat hanger distribution manifolds 6 and 8, which direct the molten polymer flow streams into two planar molten polymer flow streams. By careful selection of manifold geometry, all of the polymer has nearly the same temperature, viscosity and residence time in the manifold along the length of the plane of the molten polymer flow stream. The planar molten polymer flow streams are individually filtered through filters 10 and 12, which extend the length of the melt spinning beam. The separate planar molten polymer flow streams are fed through combining manifolds 13, and are combined into a two-layered planar molten polymer stream in the spinneret 14. The integrity of the bi-layered molten polymer flow stream is maintained while the flow stream is fed to a plurality of spinneret orifices 16 to form side-by-side filaments. The combining manifold and the spinneret can be combined into one device.

Optionally, in a melt-blowing process, as the bi-layered molten polymer flow stream emerges from the spinneret orifices, the bi-layered molten polymer flow stream can be cooled and attenuated with high speed fluid, such as air, exiting jets 20 to form very small diameter filaments.

The examples below describe the preparation of webs made from meltblown bicomponent fibers according to the process described above with reference to the apparatus of FIG. 1. Example 2 contains blue pigment in the poly (ethylene terephthalate). This addition of the pigment is useful in making a colored web.

EXAMPLE 1

A meltblown bicomponent web was made from melt blown fibers with a polyethylene component and a poly (ethylene terephthalate) component. The polyethylene component was made from linear low density polyethylene with a melt index of 135 g/10 minutes available from Equistar as GA594. The polyester component was made from poly (ethylene terephthalate) with an intrinsic viscosity of 0.53 available from E. I. duPont de Nemours and Company as Crystar® polyester (Merge 4449). The polyethylene polymer was heated to 260° C. and the polyester polymer was heated to 305° C. in separate extruders. The two polymers were separately extruded and metered to two independent coat hanger-type polymer distributors. The planar melt stream exiting each distributor were filtered independently and then combined in a bicomponent meltblowing die to provide a side-by-side filament cross section. The die was heated to 305° C. The die had 645 capillary openings arranged in a 54.6 cm line. The polymers were spun through the each capillary at a polymer throughput rate of 0.80 g/hole/min. Attenuating air was heated to a temperature of 305° C. and supplied at a pressure of 7 psig through two 1.5 mm wide air channels. The two air channels ran the length of the 54.6 cm line of capillary openings, with one channel on each side of the line of capillaries set back 1.5 mm from the capillary openings. The polyethylene was supplied to the spin pack at a rate of 6.2 kg/hr and the polyester was supplied to the spin pack at a rate of 24.8 kg/hr. A bicomponent meltblown web was produced that was 20 weight percent polyethylene and 80 weight percent polyester. The filaments were collected at a die-to-collector distance of 12.7 cm on a moving forming screen to produce a meltblown web. The meltblown web was collected on a roll. The meltblown web had a basis weight of 17 $g/m_2$.

EXAMPLE 2

A web was made according to the procedure in Example 1 except that the polyester component contained 0.05 percent blue pigment (11582-F25 Blue Phthalo available from Americhem, Inc.). The pigment was introduced with an additive feeder to the extruder throat in a 25 percent concentrate form where the base material was DuPont Crystar® (Merge 4449). The meltblown web had a basis weight of 17 $g/m^2$. No significant difference in processibility was observed due to the presence of the pigment.

Filtering of the planar molten polymer flowstreams resulted in the virtual elimination of plugging of the spinneret exit orifices, thus enhancing uniformity of the nonwoven webs formed, and extending the up-time of the spinning system.

What is claimed is:

1. A process for preparing a plurality of multi-layered filaments from multiple thermoplastic synthetic polymers comprising:

separately melting and extruding multiple thermoplastic synthetic polymers into separate molten polymer flow streams;

distributing each of said separate molten polymer flow streams into separate coat hanger manifolds to form a separate planar molten polymer flow stream of each of said polymers;

then passing said separate planar molten polymer flow streams through separate filters to filter said planar molten polymer flow streams;

passing said filtered separate planar molten polymer flow streams exiting said filters through a combining manifold within a spinneret to form a multi-layered planar molten polymer flow stream;

feeding said multi-layered planar molten polymer flow stream through a plurality of spinneret exit orifices to form multi-layered filaments; and attenuating said multi-layered filaments as they exit said plurality of spinneret exit orifices with a fluid exiting fluid jets positioned adjacent said plurality of spinneret orifices.

2. The process of claim 1, wherein the number of multiple thermoplastic synthetic polymers is two.

3. The process of claim 1, wherein the number of multiple thermoplastic synthetic polymers is greater than two.

4. An apparatus for spinning a plurality of multi-layered filaments from multiple thermoplastic synthetic polymers comprising:

multiple extruders for separately melting and extruding multiple thermoplastic synthetic polymers into molten polymer flow streams; and a melt blowing beam comprising:

separate coat hanger distribution manifolds downstream of and communicating with said extruders;

separate filters downstream of and extending essentially the length of said melt blowing beam and communicating with said coat hanger distribution manifolds;

a spinneret comprising a combining manifold having converging passages downstream of and communicating with said filters, said converging passages extending the length of and exiting said filters for combining said separate filtered planar molten polymer flow streams into a multi-layered planar molten polymer flow stream, and a plurality of spinneret exit orifices; and fluid jets positioned adjacent said spinneret exit orifices.

5. The apparatus of claim 4, which is configured for two thermoplastic synthetic polymers.

6. The apparatus of claim 4, which is configured for more than two thermoplastic synthetic polymers.

7. A melt blowing beam for forming a plurality of multi-layered filaments from multiple thermoplastic synthetic polymers which comprises multiple polymer inlet passages each communicating with a separate-multiple coat hanger distribution manifold for each polymer, separate filters downstream of and extending essentially the length of said melt blowing beam and communicating with each coat hanger distribution manifold, a spinneret comprising a combining manifold downstream of and communicating with said filters for combining separate filtered planar molten polymer flow streams exiting from said separate filters into a multi-layered planar molten polymer flow stream, said combining manifold having converging passages extending the length of said filters, a plurality of spinneret exit orifices downstream of and communicating with said combining manifold, and fluid jets positioned adjacent said spinneret exit orifices.

* * * * *

UNITED STATES PATENT AND TRADEMARK OFFICE

CERTIFICATE OF CORRECTION

PATENT NO. : 6,605,248 B2 
DATED : August 12, 2003
INVENTOR(S) : Rudisill Edgar N., Bansal Vishal and Davis Michael C.

It is certified that error appears in the above-identified patent and that said Letters Patent is hereby corrected as shown below:

Column 6,
Line 53, delete "-multiple".

Signed and Sealed this

Twenty-third Day of December, 2003

JAMES E. ROGAN
*Director of the United States Patent and Trademark Office*